US006302603B1

(12) United States Patent
Akaiwa et al.

(10) Patent No.: US 6,302,603 B1
(45) Date of Patent: Oct. 16, 2001

(54) TAPE PRINTING APPARATUS AND METHOD

(75) Inventors: Masao Akaiwa, Shiojiri; Ayumi Maseki, Hata-machi, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/551,435

(22) Filed: Apr. 18, 2000

(30) Foreign Application Priority Data

Apr. 19, 1999 (JP) ..... 11-111002

(51) Int. Cl.[7] ..... B41J 15/02
(52) U.S. Cl. ..... 400/613; 400/611
(58) Field of Search ..... 400/611, 613, 400/613.1, 615, 615.2

(56) References Cited

FOREIGN PATENT DOCUMENTS

62286726 * 12/1987 (JP) .
6122152-A * 5/1994 (JP) .
811840 * 1/1996 (JP) .
2583622 8/1998 (JP) .

* cited by examiner

*Primary Examiner*—John S. Hilten
*Assistant Examiner*—Kevin D. Williams
(74) *Attorney, Agent, or Firm*—Hogan & Hartson, L.L.P.

(57) ABSTRACT

There is provided a tape printing apparatus and method which is capable of printing characters on a heat shrink tape such that the characters are readily legible when the heat shrink tape undergoes heat shrinkage. From a keyboard, characters are input. A deformed font memory area stores a deformed font deformed from a normal font in view of heat shrinkage of a heat shrink tape which shrinks in at least one of a longitudinal direction and a lateral direction into a predetermined memorized shape when heat is applied thereto such that characters printed on the heat shrink tape by using the deformed font come to have respective shapes of the normal font when the heat shrink tape undergoes heat shrinkage. Based on the deformed font, the input characters are printed on the heat shrink tape.

6 Claims, 7 Drawing Sheets

FIG. 6

| KIND | PRINT LETTER | ASPECT RATIO | HEAT SHRINKAGE RATES | PRINT LETTER AFTER HEAT SHRINKAGE |
|---|---|---|---|---|
| 1 | CEILING LIGHT | 4 X 1 | VER. 75%<br>HOR. 0% | CEILING LIGHT |
| 2 | CEILING LIGHT | 3 X 1 | VER. 66%<br>HOR. 0% | |
| 3 | CEILING LIGHT | 2 X 1 | VER. 50%<br>HOR. 0% | |
| 4 | CEILING LIGHT | 1 X 1 | VER. 0%<br>HOR. 0% | |
| 5 | CEILING LIGHT | 2 X 3 | VER. 50%<br>HOR. 66% | |
| 6 | CEILING LIGHT | 2 X 4 | VER. 50%<br>HOR. 75% | |

TAPE PRINTING APPARATUS AND METHOD

BACKGROUND OF THE INVENTION

1. Field of the Invention

This invention relates to a tape printing apparatus and method for carrying out a printing operation in view of heat shrinkage of a heat shrink tape.

2. Prior Art

Recently, a tape printing apparatus has been proposed e.g. by Japanese Utility Model Registration Publication No. 2583622. The tape printing apparatus carries out printing on a heat shrink tape which is thermally contracted or transformed into a predetermined memorized shape when heat is applied thereto. The tape printing apparatus uses a heat shrink tape which has a hollow cylindrical shape i.e. an annular cross-sectional shape and is hard to be peeled off a cylindrical object when the tape is fitted thereon, i.e. affixed thereto. The heat shrink tape is mounted in a tape cartridge in a flattened state and wound into a roll. Desired characters are printed on the heat shrink tape unwound from the tape cartridge. This printing operation is carried out by using a normal font stored in the apparatus, similarly to the case of an ordinary tape being printed.

However, after the heat shrink tape is printed based on the normal font, when the tape is affixed to an object article for application of heat, normally, the tape is radially shrunk or contracted, and hence letters and images (characters) printed on the tape are transformed into shapes having a vertically or horizontally reduced proportion according to a shrinkage rate of the tape, which makes it hard to read the characters. Particularly when the tape is used to indicate electrical wiring, small-sized characters printed thereon become harder to be read.

SUMMARY OF THE INVENTION

It is an object of the invention to provide a tape printing apparatus and method which is capable of printing characters on a heat shrink tape such that the characters are readily legible when the heat shrink tape undergoes heat shrinkage.

To attain the above method, according to a first aspect of the invention, there is provided a tape printing apparatus for carrying out printing on a heat shrink tape which shrinks in at least one of a longitudinal direction and a lateral direction into a predetermined memorized shape when heat is applied thereto.

The tape printing apparatus is characterized by comprising:

an input device for inputting characters;

a deformed font storage device for storing a deformed font deformed from a normal font, in view of heat shrinkage of the heat shrink tape such that characters printed on the heat shrink tape by using the deformed font come to have respective shapes of the normal font when the heat shrink tape undergoes heat shrinkage; and a printing device for printing the characters input by the input device on the heat shrink tape by using the deformed font.

According to the tape printing apparatus, there is stored a deformed font deformed from a normal font, in view of heat shrinkage of the heat shrink tape such that characters printed on the heat shrink tape by using the deformed font come to have respective shapes of the normal font when the heat shrink tape undergoes heat shrinkage, and the characters can be printed on the heat shrink tape by using the deformed font. When the heat shrink tape attached to an object undergoes heat shrinkage, and the shapes of the printed characters are changed into horizontally reduced shapes, vertically reduced shapes, or totally reduced shapes. In this state, the deformed characters come to have shapes substantially identical to those of the normal font. That is, characters printed in deformed font are changed by heat shrinkage into those substantially in normal font.

It should be noted that the term "character or characters" is/are used throughout the specification to mean letters, symbols, figures, etc. which are normally input to the apparatus. The characters may be input to form any of vertical writing normally used in Japanese and Chinese writing, and horizontal writing normally employed in English and other Western languages. Further, the term "normal font" is intended to mean a set of character types each having a size substantially equal between a vertical side and a horizontal side, as a basic form thereof, and include variations of double height size, and half width size, which are normally employed in printers, word processors, and the like.

Preferably, there are provided a plurality of kinds of the heat shrink tape having respective different heat shrinkage rates, and the deformed font storage device stores a plurality of different deformed fonts corresponding respectively to the different heat shrinkage rates of the plurality of kinds of the heat shrink tape, the tape printing apparatus further including a fontselecting block for selecting an arbitrary one of the plurality of different deformed fonts.

According to this preferred embodiment, since there are stored plurality of different deformed fonts corresponding respectively to the different heat shrinkage rates of the plurality of kinds of the heat shrink tape, it is possible to carry out printing on such tapes having different heat shrinkage rates, such that characters printed thereon come to have shapes of the normal font.

More preferably, the plurality of kinds of heat shrink tape are stored in respective cartridge cases in a dispensable manner, the cartridge cases having respective identifiers for permitting identification of a kind of each of the plurality of kinds of heat shrink tape, the tape printing device including a sensor for sensing the identifiers for identification of the kind of the each of the plurality of kinds of heat shrink tape, the font-selecting block selecting one of the plurality of deformed fonts based on results of sensing by the sensor.

According to this preferred embodiment, a cartridge case containing a heat shrink tape is removably mounted in the apparatus, which makes it easy to handle the tape, and replace it. Further, the cartridge case has an identifier for identification of the kind of the each of the plurality of kinds of heat shrink tape, which may be one readably bearing information of heat shrinkage rates (vertical and horizontal) of the tape. Therefore, by sensing the identifier, one of the deformed fonts suitable for the identified tape can be automatically selected and then the characters can be printed by using the selected deformed font. Therefore, it is not required to manually set the heat shrinkage rates suitable for the tape in use, and saves the trouble of changing fonts when the tapes are replaced.

To attain the above object, according to a second aspect of the invention, there is provided a method of carrying out printing on a heat shrink tape which shrinks in at least one of a longitudinal direction and a lateral direction into a predetermined memorized shape when heat is applied thereto.

The method according to the second aspect of the invention is characterized by the steps of:

making available a deformed font deformed from a normal font in view of heat shrinkage of the heat shrink tape such that characters printed on the heat shrink tape by using the deformed font come to have respective shapes of the normal font when the heat shrink tape undergoes heat shrinkage: and printing the characters on the heat shrink tape by using the deformed font by using the deformed font.

According to this method, there is stored a deformed font deformed from a normal font, in view of heat shrinkage of the heat shrink tape such that characters printed on the heat shrink tape by using the deformed font come to have respective shapes of the normal font when the heat shrink tape undergoes heat shrinkage, and the characters can be printed on the heat shrink tape by using the deformed font. When the heat shrink tape attached to an object undergoes heat shrinkage, and the shapes of the printed characters are changed into horizontally reduced shapes, vertically reduced shapes, or totally reduced shapes. In this state, the deformed characters come to have shapes substantially identical to those of the normal font. That is, characters printed in deformed font are changed by heat shrinkage into those substantially in normal font.

The above and other objects, features, and advantages of the invention will become more apparent from the following detailed description taken in conjunction with the accompanying drawings.

BRIEF DESCRIPTION OF THE DRAWINGS

FIGS. 3A and 3B are diagrams each showing the construction of a heat shrink tape, in which:

FIG. 3A is a diagram showing the heat shrink tape in a state held in the cartridge, or printed but not yet delivered out of the apparatus;

FIG. 3B is a diagram showing the heat shrink tape in a state delivered to take a hollow cylindrical shape for being fitted on a cylindrical object;

FIG. 6 shows a table showing the relationship between printed letters and the heat shrinkage rates of the tape in the case of the horizontal writing print format being set.

DETAILED DESCRIPTION

The invention will now be described in detail with reference to drawings showing an embodiment thereof. A tape printing apparatus and a tape printing method according to the invention are configured such that it is possible to print not only on a general type of printing tape but also on a heat shrink tape (hereinafter referred to as "the tape T") which is transformed into a predetermined memorized shape by application of heat. Characters (letters, images and the like) input is printed on this tape T by a special font.

Figure 1:
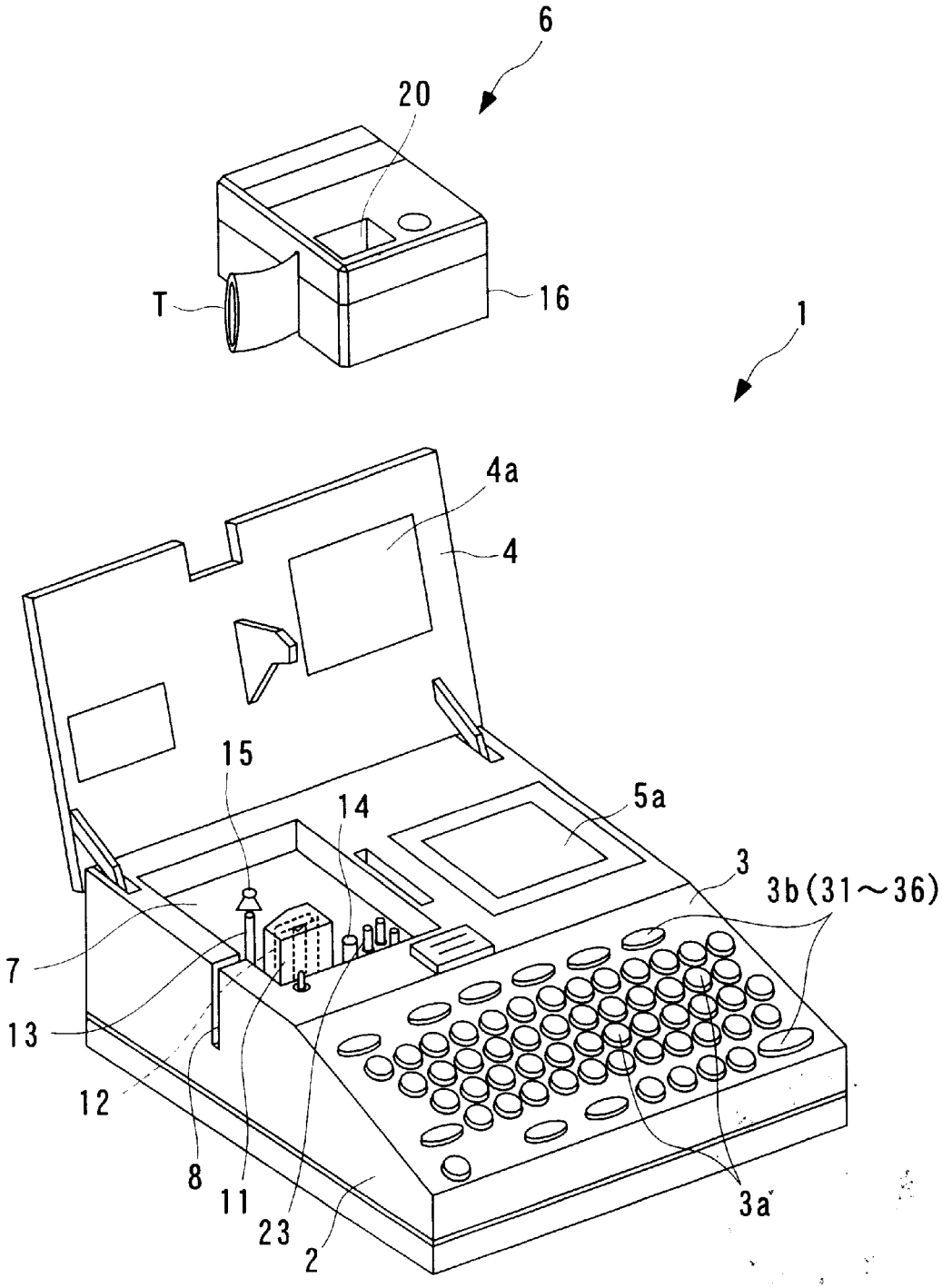
FIG. 1 is a perspective view of an appearance of a tape printing apparatus in a state in which a lid of the tape-printing apparatus is open and a cartridge is removed therefrom.

Referring first to FIG. 1, there is shown an appearance of the tape printing apparatus 1 with a lid thereof opened, in perspective. As shown in the figure, the tape printing apparatus 1 includes a casing 2 having upper and lower divisional portions. The casing 2 includes a keyboard 3 arranged on the top of the front portion thereof, and a lid 4 arranged on the top of the rear portion thereof. The keyboard 3 is comprised of various kinds of entry keys. Under the lid 4, there are formed a display screen 5*a*, and a cartridge compartment 7 as a recessed portion for receiving a cartridge 6 therein. The cartridge 6 is removably loaded in the cartridge compartment 7 when the lid 4 is open. Further, the lid 4 is formed with a window 4*a* for permitting the user to confirm or view the display screen 5*a* when the lid is closed.

On the keyboard 3, there are arranged a letter key group, not shown, and a function key group, not shown, for designating various operation modes. The letter key group is arranged in accordance with the JIS (Japanese Industrial Standards) form, thus presenting a full key arrangement. This key arrangement also includes a shift key, not shown, which is provided in order to avoid increase in the number of keys to be manipulated, as is the case with ordinary word processors. The function key group includes a cancel key 31 for cancellation of processing designated by another function key, a heat shrinkage rate-setting key 32 for setting heat shrinkage rates described hereinafter, a style key 33 for setting a orientation of letters and a letter size, cursor keys 34 for moving a cursor, a print key 35 for starting a printing operation, a selection key 36 for starting new lines during text entry as well as determining selection of one of various operating modes.

The display screen 5*a* is comprised of an indicator block for displaying a function currently executed and a main display block. The indicator block displays the settings of printing styles, such as "orientation of letters", "letter size" and the like, the settings of entry modes, and the settings of formats, such as "uniform layout", "forward alignment" and the like such that they can be checked by viewing them. In the type of the apparatus 1 which is capable of entering the Japanese language, the settings of entry modes, such as "Romaji (alphabetic) entry mode" and "Kana entry mode" can be viewed at the indicator block. Further, the main display block displays text data entered via the keyboard 3. Contents displayed on the main display block can be freely controlled and when a predetermined key entry is made, it is possible to display the layout of an image represented by the present print data. Further, information of the heat shrinkage rates and the width of a tape, detected by micro switches 23 is also displayed.

The casing 2 has a left side portion thereof formed with a tape exit 8 which communicates between the cartridge compartment 7 and the outside of the apparatus. On the tape exit 8 faces a tape cutter, not shown, for cutting a printed portion of the tape T having been sent out. The printed portion of the tape T is sent out of the tape exit 8, and this portion of the tape T is cut off by the tape cutter.

On the other hand, the cartridge compartment 7 includes a thermal head 12 having heating elements and covered with a head cover 11, a platen roller drive shaft 13 arranged in a manner opposed to the thermal head 12, a ribbon take-up reel drive shaft 14 for taking up an ink ribbon 18, and a positioning projection 15 for a tape reel 17 referred to hereinafter. Further, arranged below the cartridge compartment 7 is a tape-feeding mechanism, not shown, for rotating the platen roller drive shaft 13 and the ribbon take-up reel drive shaft 14.

Figure 2:
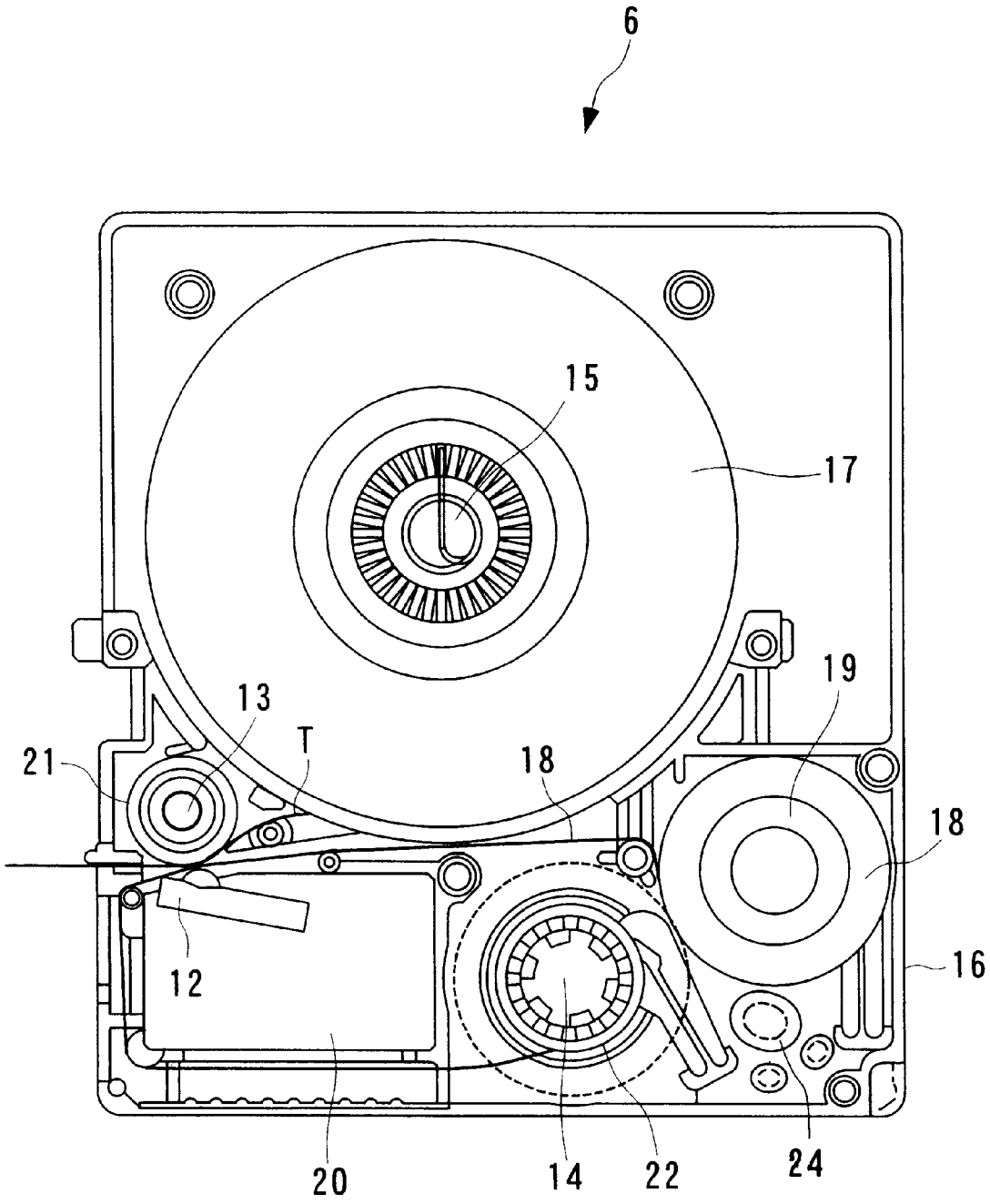
FIG. 2 is a cross-sectional view of the cartridge.

FIG. 2 shows the cartridge 6 in cross-section. As shown in the figure, the cartridge 6 has a cartridge casing 16 which has the tape reel 17 arranged at a central upper portion thereof and a ribbon reel 19 arranged at a lower right portion thereof. Around the tape reel 17 is wound the tape T, and around the ribbon reel 19 is wound an ink ribbon 18. At a lower left portion of the cartridge casing 16, a through hole 20 is formed for having the head cover 11 inserted therein. Further, in the cartridge casing 16, there is arranged a platen roller 21 which is driven for rotation by the platen roller drive shaft 13 fitted therein, in a manner corresponding to a location facing a passageway where the tape T and the ink ribbon 18 are placed one upon the other. On the other hand, a ribbon take-up reel 22 is arranged at a location close to the ribbon reel 19 such that the ink ribbon 18 unwound from the ribbon reel 19 is caused to go around the head cover 11 to be taken up by the ribbon take-up reel 22.

When the cartridge 6 is loaded in the cartridge compartment 7, the through hole 20 of the cartridge 6 is fitted on the head cover 11, the center hole of the tape reel 17 is fitted on the positioning projection 15, and the center hole of the ribbon take-up reel 22 is fitted on the ribbon take-up reel drive shaft 14. In this state, the thermal head 12 is brought into contact with the platen roller 21 in a manner sandwiching the tape T and the ink ribbon 18 therebetween, thereby enabling a printing operation.

There are provided several kinds of tape T having various heat shrinkage rates and tape widths, and to indicate the kind of tape T contained in a cartridge 6, one of a plurality of identifiers 24 corresponding to the respective kinds of tape T is arranged in the cartridge casing 16. The identifier 24 is formed by small holes (identification elements) formed in an armored outer surface of the cartridge 6, and the cartridge compartment 7 has a plurality of micro switches (detecting ends) 23 arranged thereon in a manner corresponding to the small holes of the identifier 24, for detecting the kind of tape T according to the presence or absence of each of the small holes (identification elements) and the number of the small holes of the identifier 24. The length of a protrusion of each micro switch 23 is set such that it can extend into the depth of a corresponding small hole of the identifier 24. Micro switches 23 inserted into shallow small holes of the identifier 24 are pressed and turned on by the identifier 24 which abut the micro switches 23, whereas micro switches 23 inserted into deep small holes of the identifier 24 are completely received therein, and remain off. Therefore, by detecting the state of the micro switches 23, it is possible to discriminate a type of tape T contained in the cartridge 6, i.e. the heat shrinkage rates and width of the tape T.

When the tape T is rolled out from the tape reel 17, the ink ribbon 18 is also rolled out from the ribbon reel 19 and fed or run together with the tape T in a state lying upon the tape T, followed by being taken up by the ribbon take-up reel 22. That is, the platen roller 21 and the ribbon take-up reel 22 are rotated in synchronism with each other, whereby the tape T and the ink ribbon 18 are simultaneously fed, and at the same time the thermal head 12 is driven in synchronism with running of the tape T and the ink ribbon R to thereby carry out printing.

Figure 3A:
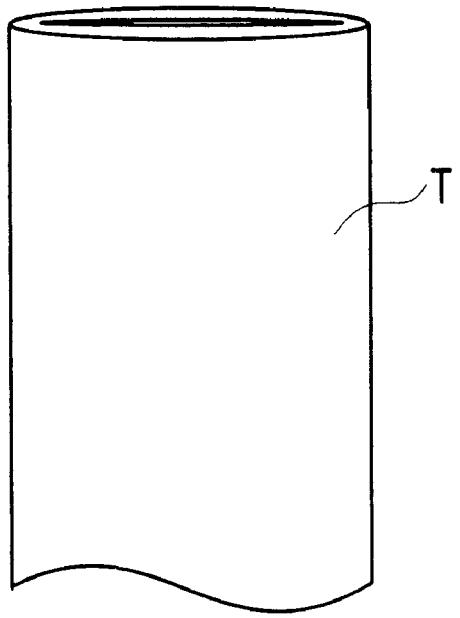
Figure 3B:
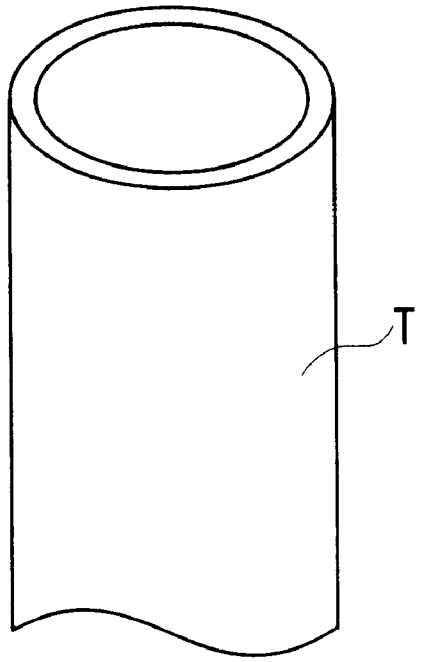

Further, the tape T has heat shrinkage properties that the tape is longitudinally and/or laterally contracted or shrunk by application of heat and thereby transformed into a predetermined memorized shape, so that as shown in FIG. 3A, the tape T remains flattened when the tape is held in the cartridge 6, or printed but not yet delivered out of the apparatus. As shown in FIG. 3B, the tape T delivered takes a hollow cylindrical shape, and is fitted on a cylindrical object. Then, the tape T is heated for shrinkage by using a dryer or the like, and thereby caused to be rigidly fitted the object article. It should be noted that it is also possible to provide an inner surface of the tape T with an adhesive layer composed of a thermosensitive adhesive which exhibits an adhesive power when heated, thereby allowing the tape to be more rigidly fitted on the object article.

Figure 4:
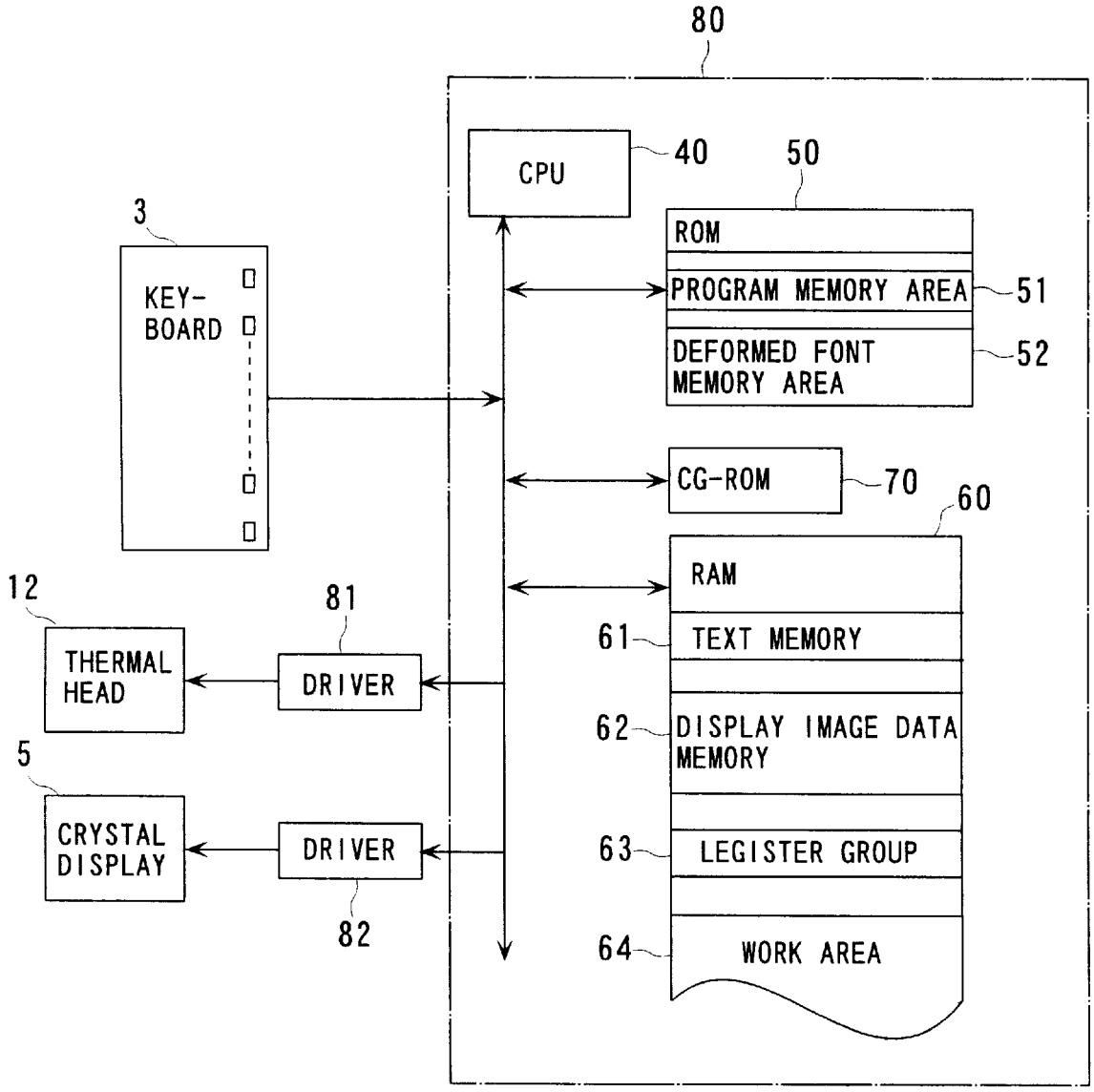
FIG. 4 is a block diagram schematically showing a control system of the FIG. 1 tape printing apparatus.

Next, a control system of the tape printing apparatus 1 will be described with reference to FIG. 4. The control system includes a control circuit 80 comprised of a CPU 40, a ROM 50, a RAM 60, and a CG-ROM 70. The control circuit 80 has its input port connected to the keyboard 3, and its output ports connected to the thermal head 12 via a driver 81 for driving the same and a liquid crystal display 5 via a driver 82 for driving the same.

The ROM 50 has a program memory area 51 storing control programs for controlling the thermal head 12 and the liquid crystal display 5, and various programs for processing operations, described hereinafter. Further, the ROM 50 has a deformed font memory area 52 storing data of a deformed font referred to hereinafter.

The RAM 60 includes a text memory 61 for temporarily storing text data of letters and images entered via the keyboard 3, a display image data memory 62 for storing image data corresponding to contents displayed on the display screen 5*a* of the liquid crystal display 5, a register group 63 for temporarily storing results of processing by the CPU 40, a work area 64 for forming image data and the like in various kinds of processing described hereinafter, and so forth. The CG-ROM 70 stores font data of letters and images provided for the tape printing apparatus 1, and outputs corresponding font data whenever code data identifying a letter is given thereto.

Next, the overall control process carried out by the tape printing apparatus 1 will be described. The tape printing apparatus according to the present invention is provided with a deformed font in view of heat shrinkage of a heat shrink tape, and prints input characters on the heat shrink tape based on the deformed font. Now, two patterns of methods, that is, a method of automatically detecting the identifier 24 arranged on the cartridge casing 16 and a method of manually entering the type of tape T will be described as methods of determining the type of tape T. Although not only the heat shrinkage rates of the tape T but also the width thereof is detected for determination of the type of tape T, only the heat shrinkage of the tape T and relevant matters will be referred to hereinafter.

Figure 5:
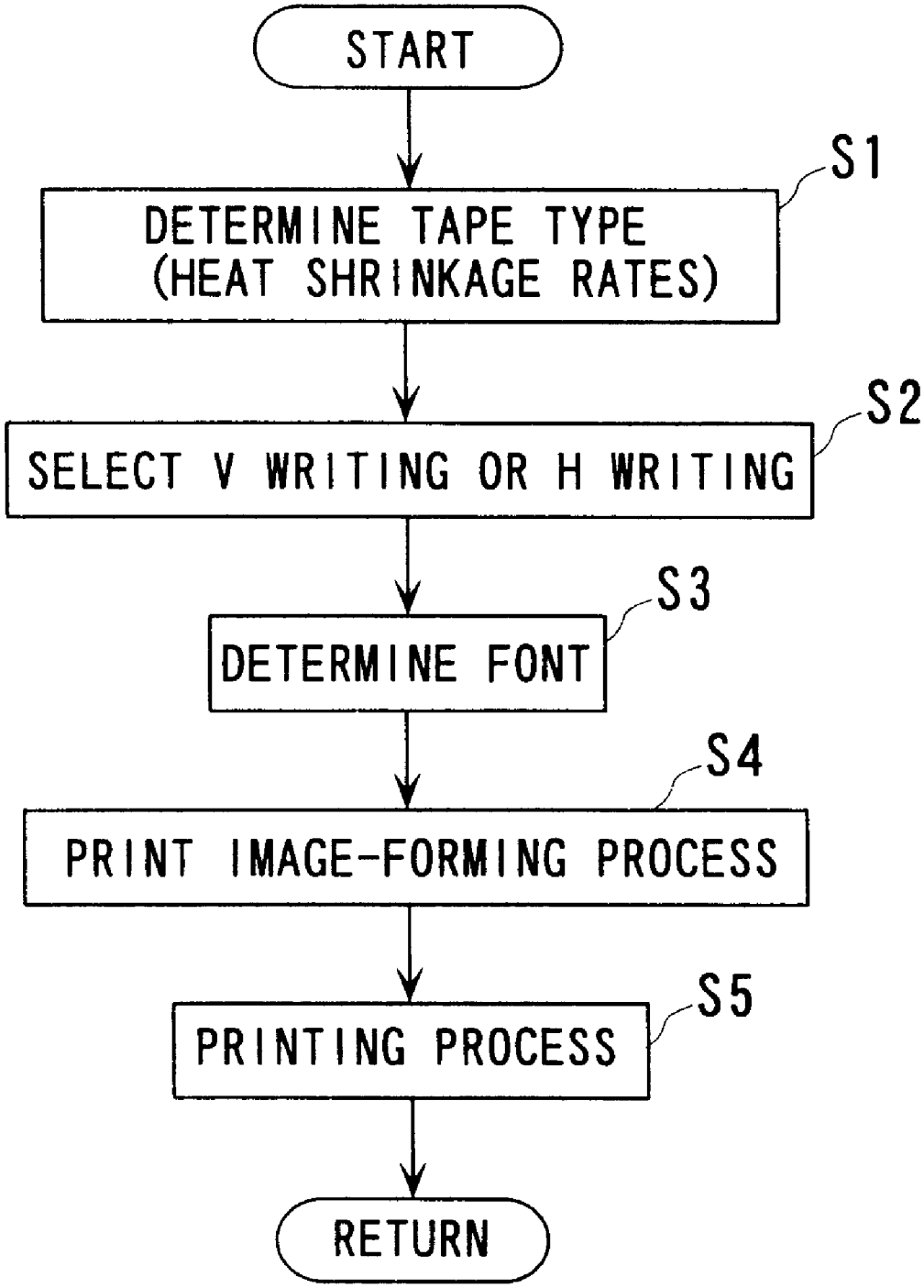
FIG. 5 is a flowchart schematically showing a process for automatically detecting heat shrinkage rates of the heat shrink tape.

First, the method of automatically detecting the identifier 24 arranged on the cartridge casing 16 is described as a method of determining the type (heat shrinkage rates) of tape T. Referring to FIG. 5, when the present control process is started by turning on the power of the apparatus 1, first, the identification elements (small holes) of the identifier 24 arranged on the cartridge casing 16 are detected by the plurality of micro switches 23 arranged in the cartridge compartment 7, and at step S1, the heat shrinkage rates of the tape T are determined based on a combination of results of detection by each micro switch 23.

After the heat shrinkage rates of the tape T are determined, it is selected at step S2 whether an orientation of letters for printing is set to "V WRITING (Vertical Writing)" or "H WRITING (Horizontal Writing)". It should be noted that "vertical writing" designates an orientation of a letter to be printed such that the vertical axis of the letter is along the direction of the length of the tape T, whereas "horizontal writing" designate an orientation of a letter to be printed such that the horizontal axis of the letter is along the direction of the length of the tape T.

Figure 7:
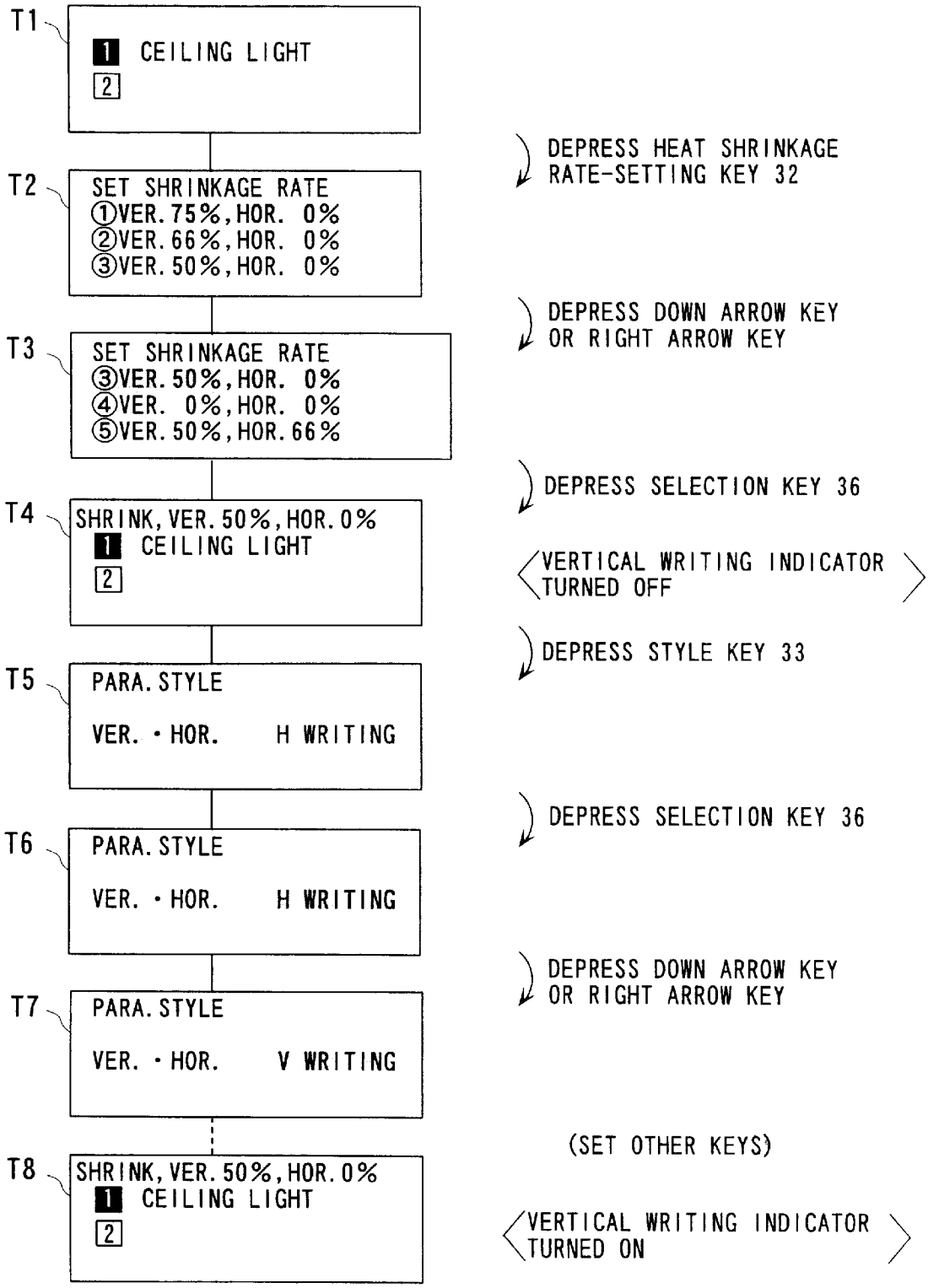
FIG. 7 is a diagram showing images of contents displayed on a display screen, which are useful in explaining operations carried out by the user for manually setting the heat shrinkage rates of the tape.

The orientation of letters is selected by using the style key 33. When the style key 33 is depressed, it becomes possible to select between "V WRITING" and "H WRITING" (see T5 in FIG. 7). If the default option "H WRITING" is acceptable, the selection key 36 is depressed (see T6 in FIG. 7). Alternatively, when the orientation of letters is to be set to "V WRITING", by depressing one of the cursor keys 34 (down arrow key or right arrow key), an option of "V WRITING" is displayed in place of the option "H WRITING" (see T7 in FIG. 7), and by depressing the selection key 36, the vertical writing print format is set to "V WRITING". Further, although the printing style "orientation of letters" is normally set on a paragraph-byparagraph basis, this is not limitative, but in the case of a heat shrink tape being mounted, if any paragraph is set to the print format of "V WRITING", the other paragraphs are also set to the same format.

Next, a suitable font is determined at step S3 according to the detected heat shrinkage rates of the tape T and results of the selection of the orientation of letters. FIG. 6 shows the relationship between printed letters and the heat shrinkage rates of tapes contained in respective six kinds of cartridges "1" to "6" in the case of "H WRITING". For instance, when a cartridge "3" selected from the six kinds of cartridges is mounted, and information of the heat shrinkage rates of the tape T being respectively 50% in the vertical direction and 0% in the horizontal direction is detected, and if the orientation of letters is set to "H WRITING", the deformed font having an aspect ratio of 2×1 is set or determined so as to allow the deformed font to be converted to a normal font after the heat shrinkage of the tape T. If "V WRITING" is set as the orientation of letters at the step S2, a deformed font in which the aspect ratio inverted from that of the deformed font in "H WRITING" (deformed font having an aspect ratio of 1×2, in this example) is determined.

Then, after determination of a font for use in printing, data of the deformed font corresponding to input characters is read out from the deformed font memory area 52, and print image data is formed at step S4. At the same time, when the tape T is a heat shrink tape, the heat shrinkage rates of the tape in the vertical and horizontal directions are displayed on the main display block of the display screen 5*a*. When the orientation of letters is set to "H WRITING", a vertical writing indicator of an indicator group is turned off, whereas when the orientation of letters is set to "V WRITING", the vertical writing indicator is turned on (see T4, T8 in FIG. 7). At step S5, printing is carried out based on print image data read out.

In the above description, the method of determining the type (heat shrinkage rates) of tape T by automatically detecting the identification elements (small holes) of the identifier 24 arranged on the cartridge casing 16 was described. Next, the method in which the type of tape T is set by the user will be described with reference to FIG. 7. First, when the "heat shrinkage rate-setting key" 32, which is a function key of the function key group, is depressed in the state of desired characters having been entered, the screen is switched to a heat shrinkage rate-setting screen (T2). As shown in FIG. 6, there are provided six combinations of selectable heat shrinkage rates from which one combination coincident with the heat shrinkage rates of the tape T is selected. For instance, when a tape having heat shrinkage rates of 50% in the vertical direction and 0% in the horizontal direction is used, one of the cursor keys 34 is operated (the down arrow key or the right arrow key is depressed two times in this case), to highlight an option "(3) VER. 50% HOR. 0%" (T3), and the selection key is depressed for selecting the option. Now, since the default orientation of letters is set to "H WRITING", the vertical writing indicator remains OFF, and heat shrinkage rates in the vertical and horizontal directions are displayed on the main display block (T4). Further, when the print key 35 is depressed at this time point, the letters are printed based on the deformed font having a aspect ratio of 2×1. If the orientation of letters is desired to be changed to vertical writing, as described hereinabove, the style key 33 is depressed to thereby enable the option "V WRITING" or "H WRITING" to be selected (T5), and then by depressing the selection key 36, the option "H WRITING" is highlighted (T6). Next, when the down arrow key or the right arrow key is depressed, the option "H WRITING" is displayed in place of the option "V WRITING" (see T7 in FIG. 7), and by depressing the selection key 36, the vertical writing print format (V WRITING) is set. It should be noted that in the case of a heat shrink tape being mounted, if any paragraph is set to the vertical writing print format, the other paragraphs are also set to the vertical writing print format. When a font for use in printing is determined by the above operations, the following processes (steps S4 and S5 in FIG. 5) are carried out in the same manner as described hereinabove.

As described above, in the tape printing apparatus and the tape printing method according to the present invention, it is possible to store a deformed font in view of heat shrinkage of a heat shrink tape, such that the deformed font is converted to a normal font after the heat shrinkage of the tape T, and print entered characters on a tape based on the deformed font. Therefore, the tape printing apparatus and method according to the present invention do not suffer from the problem that when a heat shrink tape printed with characters is affixed to an object and undergoes heat shrinkage, the characters are transformed into a shape having a vertically or horizontally reduced proportion in accordance with heat shrinkage of the tape to thereby make the characters illegible. Further, the method of detecting the identification elements (small holes) of the identifier 24 arranged in the cartridge casing 16 to thereby determine the heat shrinkage rates of a tape makes it unnecessary to set heat shrinkage rates of the tape and saves the trouble of changing a font when the tape is replaced with a new one.

It should be noted that the tape printing apparatus 1 according to the invention is not limited to the above embodiment. For instance, although in the above-mentioned method in which heat shrinkage rates of a tape are set by the user, it was assumed that the heat shrinkage rates are selected from six combinations of shrinkage rates, the heat shrinkage rates are not limited to these combinations. Further, each of heat shrinkage rates of a tape in the vertical and horizontal directions may be input by using a number key or the like, without being prepossessed with nominal heat shrinkage rates of the tape.

Further, also when heat shrinkage rates of a tape are automatically detected, the settings thereof may be changed according to use thereof or as the user desires.

Further, although in the present embodiment, the case of letters being printed on one line is described by way of example, this is not limitative, but it is possible to print letters on a plurality of lines. In this case, when a printing process is started, first, the relationship between the sizes of letter strings on the respective lines is read (stored), and a suitable font for printing each line is determined according to results of the reading operation and results of detection by the micro switches 23.

Further, the apparatus 1 may be configured such that the identification elements of the identifier 24 are arranged within the cartridge or protrude out of the cartridge.

Further, although in the present embodiment, it was assumed that heat shrinkage rates of a tape in the vertical and horizontal directions are displayed on the main display block of the display screen 5*a*, the indication of the rates may be effected by indicators or the like.

Furthermore, when a heat shrinkage rate of a tape is large, characters printed based on a deformed font can be difficult to read before they are shrunk, so that characters may be printed based on a normal font as well as the deformed font such that contents of the printed characters can be confirmed with ease before the tape undergoes heat shrinkage.

It is further understood by those skilled in the art that the foregoing is a preferred embodiment of the invention, and that various changes and modifications may be made without departing from the spirit and scope thereof.

What is claimed is:

1. A tape printing apparatus for carrying out printing on a heat shrink tape which shrinks in at least one of a longitudinal direction and a lateral direction into a predetermined memorized shape when heat is applied thereto, the tape printing apparatus comprising:

an input device for inputting characters;

a deformed font storage device for storing a deformed font deformed from a normal font, in view of heat shrinkage of said heat shrink tape such that characters printed on said heat shrink tape by using said deformed font come to have respective shapes of said normal font when said heat shrink tape undergoes heat shrinkage; and a printing device for printing said characters input by said input device on said heat shrink tape by using the deformed font.

2. A tape printing apparatus in accordance with claim 1, further comprising a normal font storage device for storing said normal font, and wherein said printing device prints said characters input by said input device on said heat shrink tape based on said normal font as well as said deformed font.

3. A tape printing apparatus according to claim 1, wherein there are provided a plurality of kinds of said heat shrink tape having respective different heat shrinkage rates, and wherein said deformed font storage device stores a plurality of different deformed fonts corresponding respectively to said different heat shrinkage rates of said plurality of kinds of said heat shrink tape, the tape printing apparatus further including a font-selecting block for selecting an arbitrary one of said plurality of different deformed fonts.

4. A tape printing apparatus according to claim 3, wherein said plurality of kinds of heat shrink tape are stored in respective cartridge cases in a dispensable manner, said cartridge cases having respective identifiers for permitting identification of a kind of each of said plurality of kinds of heat shrink tape, the tape printing device including a sensor for sensing said identifiers for identification of said kind of said each of said plurality of kinds of heat shrink tape, said font-selecting block selecting one of said plurality of deformed fonts based on results of sensing by said sensor.

5. A method of carrying out printing on a heat shrink tape which shrinks in at least one of a longitudinal direction and a lateral direction into a predetermined memorized shape when heat is applied thereto, the method comprising the steps of:

making available a deformed font deformed from a normal font in view of heat shrinkage of said heat shrink tape such that characters printed on said heat shrink tape by using said deformed font come to have respective shapes of said normal font when said heat shrink tape undergoes heat shrinkage; and printing said characters on said heat shrink tape by using said deformed font.

6. A method of carrying out printing in accordance with claim 5, comprising the further step of storing said normal font, and wherein said printing step comprises printing said characters on said heat shrink tape based on said normal font as well as said deformed font.

* * * * *